US005810320A

United States Patent [19]

Claesson

[11] Patent Number: 5,810,320

[45] Date of Patent: Sep. 22, 1998

[54] WEIGH-BALANCING STAND ARRANGEMENT

[75] Inventor: Alf Claesson, Nykvarn, Sweden

[73] Assignee: Kinnarps AB, Kinnarp, Sweden

[21] Appl. No.: 817,074

[22] PCT Filed: Oct. 2, 1995

[86] PCT No.: PCT/SE95/01119

§ 371 Date: Apr. 4, 1997

§ 102(e) Date: Apr. 4, 1997

[87] PCT Pub. No.: WO96/10935

PCT Pub. Date: Apr. 18, 1996

[30] Foreign Application Priority Data

Oct. 6, 1994 [SE] Sweden ..... 9403388

[51] Int. Cl.[6] ..... A47B 9/00

[52] U.S. Cl. ..... 248/618; 108/147; 248/421; 248/631

[58] Field of Search ..... 248/421, 422, 248/584, 592, 594, 631, 618; 108/144, 145, 146, 147, 147.19

[56] References Cited

U.S. PATENT DOCUMENTS

| | | | |
|---|---|---|---|
| 208,083 | 9/1878 | Gorrell | 248/592 X |
| 318,593 | 5/1885 | Behrens | 108/145 |
| 730,451 | 6/1903 | Friend | 108/145 X |
| 3,216,378 | 11/1965 | Hoppe | 108/147 |
| 4,360,180 | 11/1982 | Bruneau . | |
| 4,515,087 | 5/1985 | Kurrasch | 108/147 |
| 4,558,648 | 12/1985 | Franklin et al. . | |
| 4,627,591 | 12/1986 | Heckman . | |
| 5,083,514 | 1/1992 | Schwartz et al. | 108/147 |
| 5,402,737 | 4/1995 | Kanazawa | 108/147 |
| 5,687,655 | 11/1997 | Weinschank, Jr. et al. | 108/147 |

FOREIGN PATENT DOCUMENTS

| | | |
|---|---|---|
| 2146082 | 3/1973 | Germany . |
| 1554340 | 11/1989 | Germany . |

*Primary Examiner*—Ramon O. Ramirez
*Assistant Examiner*—Derek J. Berger
*Attorney, Agent, or Firm*—Burns, Doane, Swecker & Mathis, L.L.P.

[57] ABSTRACT

A weight-balancing stand arrangement supports a sheet of material or the like and includes a bottom stand-part and a top stand-part. The top stand-part includes a horizontal beam provided with a horizontal guide surface. The guide surface coacts with widely spaced apart end portions of two guide rods, the opposite end-parts of which are placed closer together and are pivotally mounted on the bottom stand-part and coact with one or more devices which function to forcibly create a clear related rotational pattern for the two guide rods. The arrangement also includes spring devices which act between the bottom stand-part and at least one of the guide rods.

26 Claims, 4 Drawing Sheets

Fig. 1
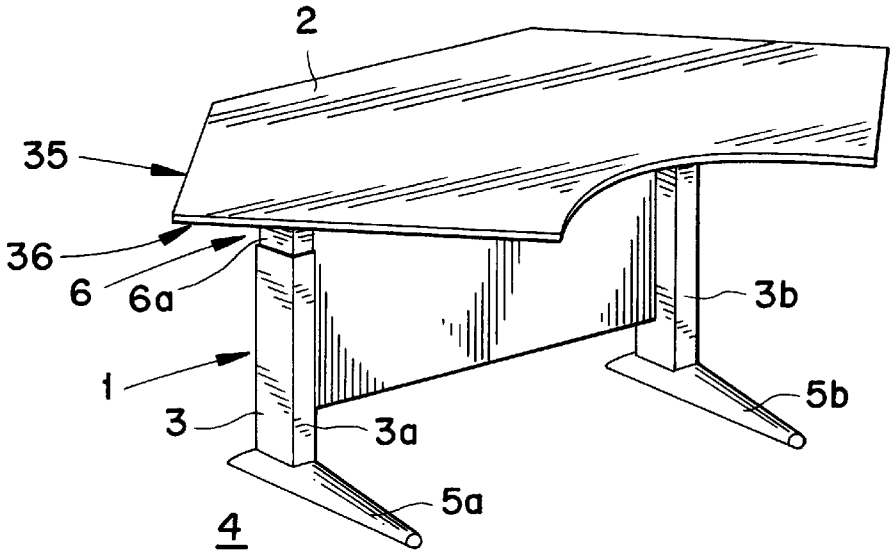
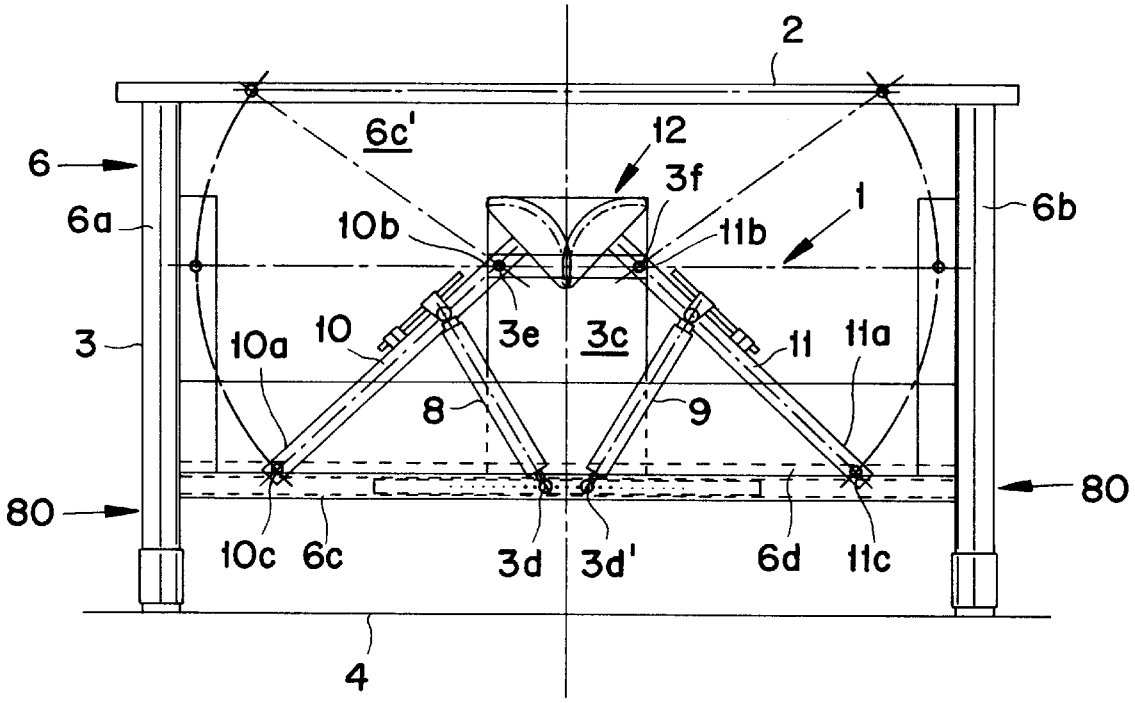
Fig. 2

Fig. 3
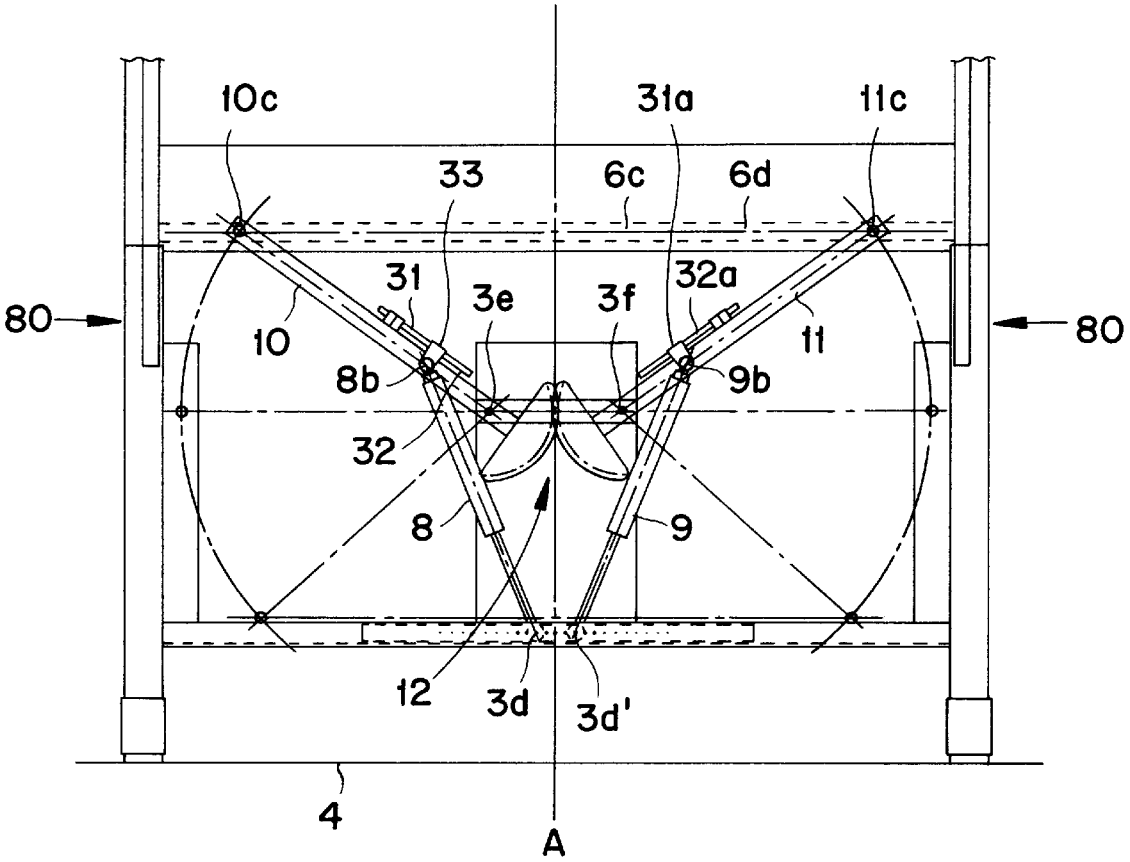
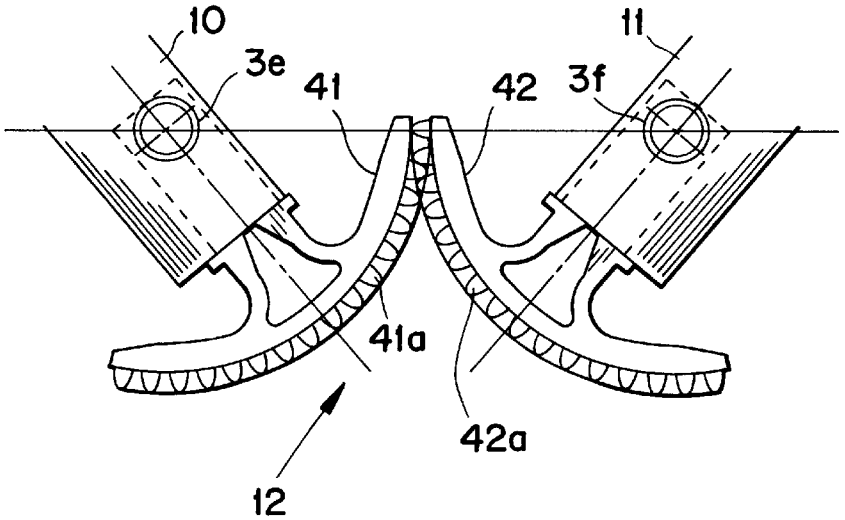
Fig. 4

Fig. 5
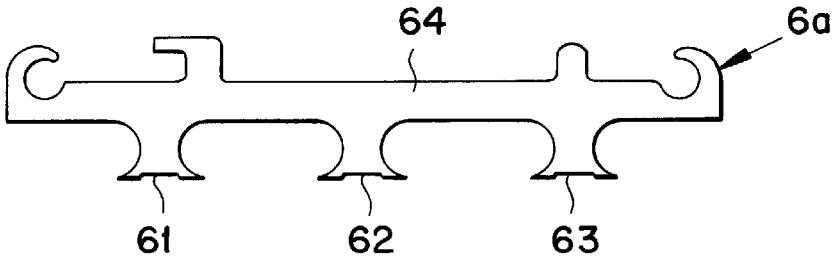
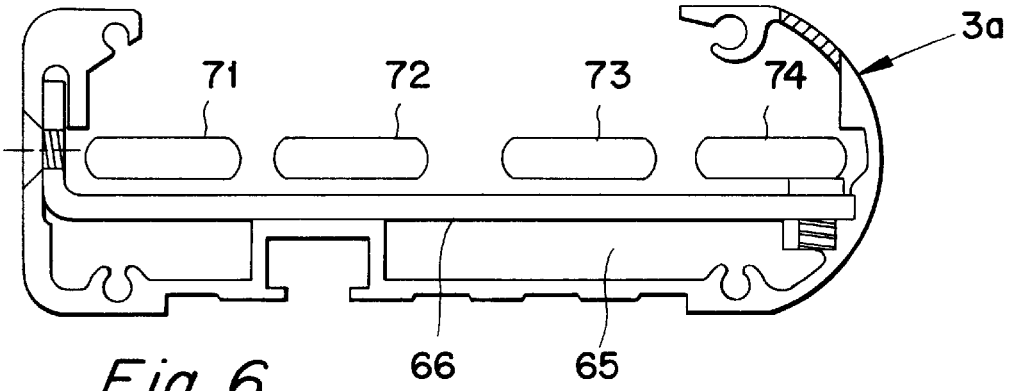
Fig. 6
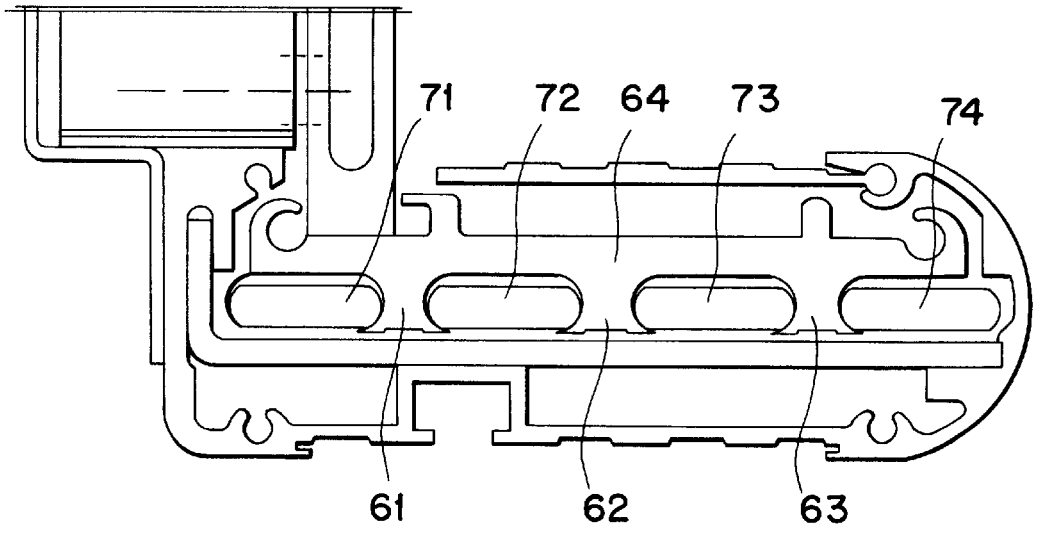
Fig. 7

Fig. 8
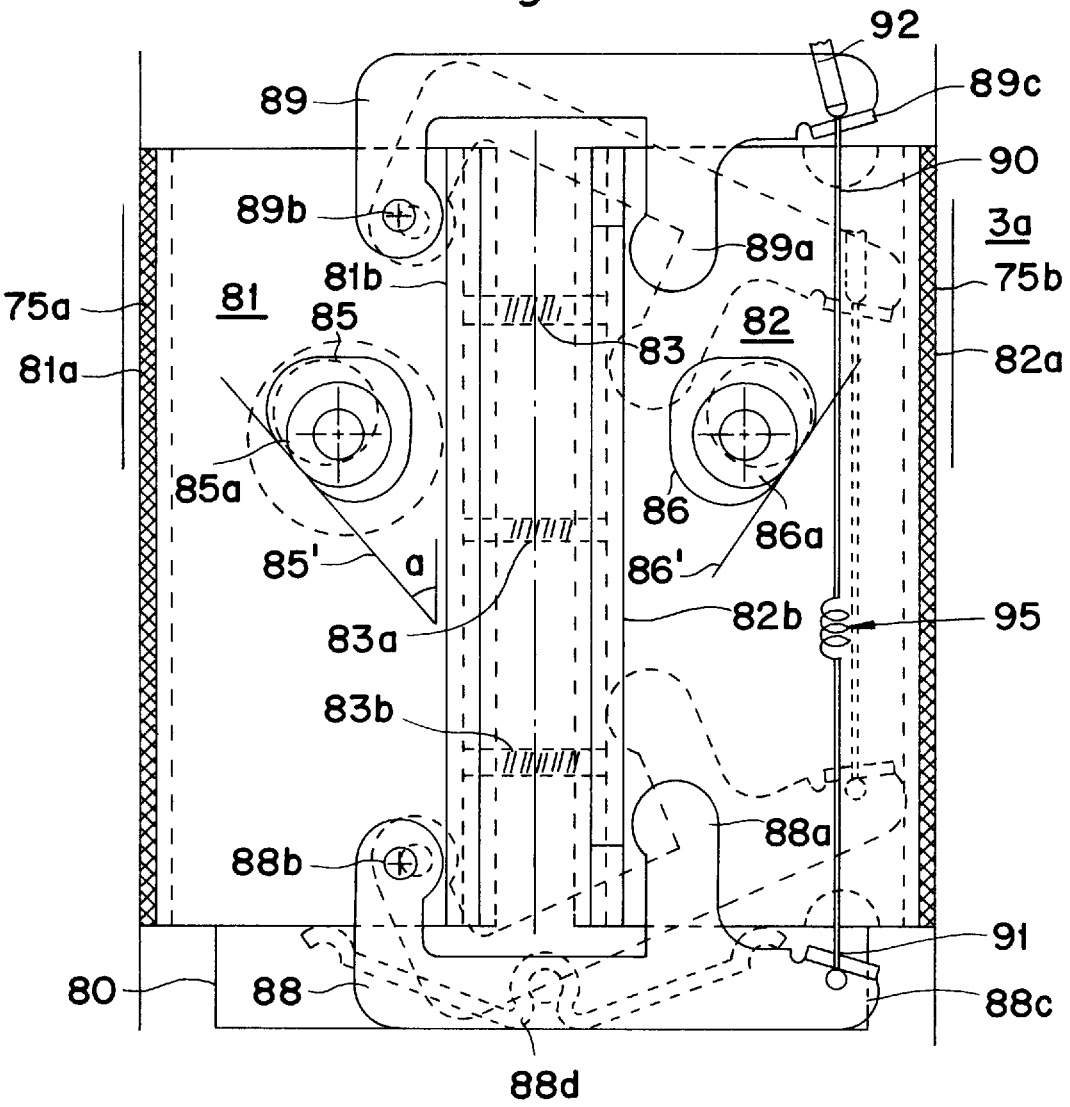
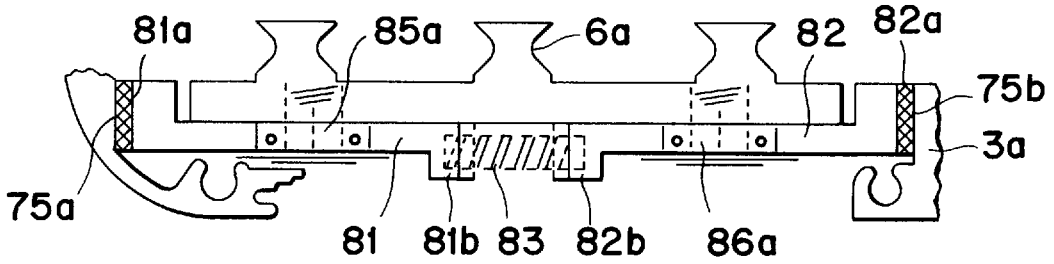
Fig. 9

WEIGH-BALANCING STAND ARRANGEMENT

TECHNICAL FIELD

The present invention relates to a weight-balancing stand arrangement and then particularly, but not exclusively, to a weight-balancing stand arrangement which is constructed to support a sheet or slab of material, wherein the stand functions to raise and lower the sheet of material with the same or essentially the same force, which acts at least in the direction of sheet movement.

The sheet of material may have the form of a table leaf or table top, a work bench or some like device, although the form taken by the sheet of material and its purpose have no significance to the invention.

The invention finds particular application when the sheet of material is intended to support various pieces of apparatus and devices where the weight exerted by the apparatus and devices on the sheet will vary from time to time and is distributed differently over the surface of said sheet.

An inventive weight-balancing stand arrangement is comprised of a bottom stand-part and a top stand-part, wherein the bottom stand-part has a form which is related to the top stand-part so that said parts can be raised and lowered relative to one another and therewith raise or lower the sheet supported thereby.

The stand arrangement also includes an activatable and deactivatable locking device which is able to adopt automatically a locking state at each selected positional setting of respective stand-parts, among other things so as to be able to support loads on the sheet without the forces generated thereby being able to change the relative positional settings of the stand-parts, and can be brought manually to a release position in which the sheet can be raised or lowered together with the upper stand-part from said selected positional setting to a new positional setting, at each selected positional setting of the stand-parts.

The stand arrangement also includes at least one weight-balancing spring means which when the top stand-part is raised or lowered functions to change the force required herefor, i.e. reduces the force required to raise the top frame part in relation to the bottom frame part, and vice versa, therewith enabling the top frame part to be raised or lowered in relation to the bottom frame part with essentially the same force in the anticipated direction of movement.

DESCRIPTION OF THE PRIOR ART

Weight-balancing stand arrangements of the aforedescribed kind are known to the art in several different forms.

For instance, one known weight-balancing stand arrangement includes leg devices which cross one another between the bottom stand-part and the top stand-part of said stand arrangement.

With the intention of equalizing weight and/or balancing weight in stand arrangements of the aforesaid kind, it is known to use spring means that are compressed and expanded in accordance with vertical movement of the sheet supported by the stand.

It is also known to use spring means in the form of one or more gas-spring devices.

As an example of the known prior art, reference is made to the teachings of U.S. Pat. No. 4,558,648.

This patent specification teaches a weight-balancing stand arrangement in which a bottom stand-part and a top stand-part are mutually connected through the medium of scissor-like leg means and where a gas-spring device is provided for relieving forces that would otherwise occur when raising or lowering a sheet supported by the stand.

The specification refers to the possibility of storing the energy recovered when lowering said sheet and the forces exerted by apparatus and the like supported by the sheet by compressing a gas volume, and to utilize the stored energy to raise the sheet and said apparatus from a lower position to a higher position with the aid of a smaller lifting force than would have otherwise been required.

Stand constructions are also known which have vertical and mutually parallel telescopic legs by means of which a stand-supported sheet of material can be raised and lowered to different positional settings.

Stand constructions are also known in which a stand-supported sheet can be brought to a working height by manually operating the stand.

The present invention relates to a stand construction of this latter kind.

It can be mentioned with regard to the inventive stand arrangement that several different types of locking devices are known to the art.

The invention utilizes the kind of locking devices that are self-locking insofar that locking jaws are sprung to a clamping and locking state, an activated state, and moved back from their locking state by hand.

It is also known to provide self-clamping locking jaws, by which is meant locking jaws whose locking or gripping ability is enhanced when the force between the locked stand components increases.

The present invention is based on the use of a locking device which is adapted for use with telescopically-related supportive leg portions and with a vertically acting load.

SUMMARY OF THE INVENTION

Technical Problems

When considering the state of the prior art as described above, it will be seen that a technical problem resides in providing a weight-balancing stand arrangement which lacks mutually crossing legs, or scissor-type legs, and with which a sheet supported on the stand can be raised or lowered in a perfectly horizontal position during relative vertical movement between a bottom stand-part and a top stand-part, essentially irrespective of the total weight supported by the sheet at that instance, for instance a weight of up to at least 100 kg, and irrespective of how the load is distributed.

It will also be seen that a technical problem resides in the provision of conditions which will enable the sheet and apparatus and articles supported thereby to be raised easily to predetermined heights, wherein the force required to raise the sheet in its direction of movement shall correspond with the force required to lower the sheet, and wherein special measures can be taken to achieve the same lifting and lowering force values when the load varies.

It will also be seen that a technical problem resides in realizing the significance of providing an upper stand-part with a horizontal beam that includes a horizontal guide surface, and to realize in conjunction therewith that said guide surface shall coact with mutually opposing end-parts of two guide rods which have mutually opposing end-parts which are rotatably mounted in a bottom stand-part and which coact with a means which functions to generate forcibly a clear and concise pattern of rotation of the two guide rods, so that the sheet supported by the stand will be kept horizontal at least as it is raised and lowered.

It will also be seen that a technical problem is one of realizing the significance of using spring means in this regard and in realizing that said spring means shall coact between said bottom stand-part and at least one of said guide rods.

It will also be seen that a technical problem resides in realizing the significance of providing the top stand-part with at least two horizontal beams and to provide the lowermost of said horizontal beams with said guide surface. It will also be seen that another technical problem is one of implementing the simple construction measures that are required to give said guide surface the form of a horizontal groove or track.

Another technical problem is one of realizing the significance of providing respective mutually opposite end-parts of said guide rods with bearing means, such as ball bearings or roller bearings adapted for movement along said horizontal guide track.

It will also be seen that a technical problem is one of realizing the significance of, and the advantages associated with pivotally mounting each guide rod to said bottom stand-part on a respective pivot shaft and to position the pivot shafts at a chosen horizontal distance from one another with a structural member positioned between said pivot shafts.

It will also be seen that a technical problem resides in realizing the advantages that are gained when said structural member has the form of mutually opposite gear segments.

In the case of a construction of the kind defined in the introduction, it will be seen that a technical problem resides in realizing the advantages that are afforded when the aforesaid spring means comprises at least one gas-spring device of known design.

Preferably, two spring means will be used with attachment points on the bottom stand-part, these attachment points being coordinated so that the spring means are outwardly divergent.

It will also be seen that a technical problem resides in realizing the significance of allowing the two spring means to be orientated with attachment points belonging to guide rods and located to one side of said pivot shafts.

It will also be seen that a technical problem resides in realizing the significance of and the advantages afforded by permitting at least one attachment point of a respective spring means to be adjustable so as to enable the effect of the spring means to be increased or decreased when raising or lowering said sheet.

It will also be seen that a technical problem is one of realizing the significance of providing the top stand-part with at least two vertically extending bar portions of specific cross-sectional shape, and to provide the bottom stand-part with at least two vertically extending bar portions of another specific cross-sectional shape, where the cross-sectional shapes of said top and bottom bar-portions are adapted for vertical telescopic movement in relation to one another, and to include locking means which are brought automatically to a locking state by spring means.

It will also be seen that a technical problem resides in realizing the advantages that are afforded when the bar-portions of the top stand-part have a cross-sectional shape which can be partially enclosed in a cavity formed by the cross-sectional shape of the bar-portion of the bottom stand-part.

It will also be seen that a technical problem resides in realizing the significance of and the advantages afforded by using a number of guide rollers or runners and in realizing that these guide rollers or runners shall be attached to the bar portion of the bottom stand-part and partially enclosed by a cavity formed by said cross-sectional shape of the bar portion of the bottom stand-part.

It will also be seen that a technical problem resides in realizing the significance of using an easily activated locking means, and to realize the advantages that are afforded when mounting said locking means within the bar portion of the top stand-part and constructing said locking means so that an initial clamping action is effected against opposing surface sections of the bar portion of the bottom stand-part.

It will also be seen that a technical problem resides in realizing the significance of designing the locking means to include two locking or clamping jaws which are constantly pressed apart by intermediate spring means such as to lock or clamp against opposing surface sections.

It will also be seen that a technical problem resides in realizing the significance of enabling the clamping jaws to be moved towards one another and slightly downwards in order to release the locking function.

It will also be seen that a technical problem resides in providing conditions with the aid of simple means which function to prevent the release or de activation of the locking means when the sheet supported by said stand carries a heavy load.

Another technical problem in this regard is to realize the significance of using a force-limiting device in coaction with the locking or clamping jaws.

Another technical problem is one of providing with the aid of simple means conditions such that the movement pattern of the clamping jaws will afford a self-clamping function with the possibility of preventing deactivation of the locking means when the sheet is overloaded.

Solution

With the intention of solving one or more of the aforesaid technical problems, the present invention takes as its starting point a weight-balancing stand arrangement which is adapted to support a sheet of material or the like and which comprises a bottom stand-part and an upper stand-part, wherein the bottom stand-part has a form in relation to the top stand-part which will enable the top stand-part to be raised or lowered in relation to the bottom stand-part and in relation to an underlying supportive surface.

The stand arrangement includes an automatically activatable and a manually deactivatable locking means which is adapted to take automatically a locking position in each chosen positional setting between the stand-parts, said locking means being capable of resisting loads acting on said sheet without changing said positional setting, and is capable of being released manually from its locking state at each selected positional setting of the stand-parts, so as to enable the sheet and the top stand-part to be raised or lowered from said selected positional setting to a new positional setting.

The inventive stand arrangement will include at least one spring device, normally two spring devices, which functions to adapt the force required to raise or lower said top stand-part on each raising and lowering occasion, by transforming a change in potential energy represented by the vertical height of the sheet to a commensurate pressure change in a gas-spring device.

In accordance with the present invention, it is proposed that a horizontal beam in the top stand-part of a weight-balancing stand arrangement of the kind defined in the introduction is provided with a horizontal guide surface, that said guide surface coacts with respective widely spaced end-parts of two guide rods whose other end-parts are relatively close together and pivotally mounted on the bottom stand-part and coact with means adapted to forcibly rotate the two guide rods in a clear and precise rotational pattern, and that said spring devices are arranged to act between said bottom stand-part and at least one of said guide rods.

As preferred embodiments which lie within the scope of the inventive concept, it is proposed that the top stand-part is provided with at least two vertically spaced horizontal beams, and that the lowermost horizontal beam is provided with said guide surface.

In one embodiment of the invention, the guide surface has the form of a horizontal groove or track, and each of the widely spaced end-parts of the guide rods is provided with a respective bearing means, such as ball bearings or roller bearings, which are intended to run backwards and forwards along said guide track.

It is also proposed that each guide rod is pivotally attached to the bottom stand-part by a respective pivot shaft, and that the pivot shafts are spaced horizontally apart and that a functional device is arranged between the pivot shafts.

According to one particular embodiment of the invention, said functional device is comprised of mutually opposing gear segments and the spring means is comprised of at least one, normally two, gas-spring devices.

When the stand arrangement includes two spring means, such as two gas springs, the spring means are mounted on attachment points on the bottom stand-part in a manner such that the spring means will mutually diverge.

It is also proposed that the two spring means are mounted on guide-rod associated attachment points located laterally of the pivot shafts.

It is also proposed that at least one attachment point of a respective spring means is adjustable, so that the force exerted by said spring means can be adjusted.

It is also proposed that the top stand-part includes at least two vertically extending bar-portions of specific cross-sectional shape.

It is also proposed that the bottom stand-part includes at least two vertically extending bar-portions of another specific cross-sectional shape.

The bar-portions of the top stand-part may be given a cross-sectional shape which can be encircled at least partially by a cavity formed by the chosen cross-sectional shape of the bar-portion of the bottom stand-part.

It is also proposed that a number of guide rollers or runners are attached to the bar-portions of the bottom stand-part such as to be enclosed, either completely or partially, by the cavity formed by the cross-sectional shape of the bar-portion of the bottom stand-part.

The invention also proposes the use of a locking device within the bar-portion of the top stand-part, and that this locking device functions to clamp automatically against opposing surface sections of the bar-portion of the bottom stand-part.

It is proposed that the locking device is comprised of at least two locking or clamping jaws which are constantly urged apart by intermediate springs, so as to lock movement of the stand-parts, wherein said locking or clamping jaws can be moved manually towards one another and slightly downwards against the action of said springs, to release the locking function.

Advantages

Those advantages that are primarily afforded by an inventive weight-balancing stand arrangement reside in the provision of conditions which will enable a sheet of material carried by the stand arrangement and supporting apparatus, devices and articles, for instance a table top, to be readily raised and lowered to a predetermined position, and in the provision of means which ensure that the table top will move horizontally irrespective of the distribution of its load, and in the provision of means which keep the force required to raise and lower the table top in its direction of movement constant, irrespective of the forces acting thereon and irrespective of the distribution of the load over the surface of the table top, normally within a weight range of beneath 100 kg.

The primary characteristic features of an inventive weight-balancing stand arrangement are set forth in the characterizing clause of the following claim 1.

BRIEF DESCRIPTION OF THE DRAWINGS

An embodiment of an inventive arrangement at present preferred and including locking means will now be described in more detail with reference to the accompanying drawings, in which FIG. 1 is a perspective view of a weight-balancing stand arrangement and a sheet of material supported thereby;

FIG. 2 is a side view of the stand arrangement with the sheet of material in a lowermost position;

FIG. 3 is a side view of the stand arrangement with the sheet of material in an uppermost position;

FIG. 4 illustrates an embodiment of means for forcibly generating a clear and precise rotational pattern, and horizontal raising and lowering of the sheet of material;

FIG. 5 is a cross-sectional view of a vertically extending bar-portion belonging to the top stand-part;

FIG. 6 is a cross-sectional view of a vertically extending bar-portion belonging to the bottom stand-part and a guide-roller unit housed in said bar-portion;

FIG. 7 illustrates the two bar-portions of FIGS. 5 and 6 in a mutually coacting position;

FIG. 8 illustrates from above a locking device which is fixed relative to a vertically extending bar-portion of the top stand-part and acting against opposing surface parts of a vertically extending bar-portion belonging to the bottom stand-part; and FIG. 9 is a sectional view of the locking device fastened to a bar-portion according to FIG. 5 and related to a bar-portion according to FIG. 6.

DESCRIPTION OF EMBODIMENTS AT PRESENT PREFERRED

FIG. 1 is a perspective view of a weight-balancing stand arrangement 1 which functions to support a sheet of material 2, e.g. a table top, work top, bench top, desk top or some like sheet structure.

The external shape of the sheet 2 is not significant to the present invention and will not therefore be described.

The weight-balancing stand arrangement 1 is comprised of a bottom stand-part 3 which includes two vertically extending bar-portions 3*a,* 3*b.* The bottom parts of the bar-portions are shown resting against a supportive surface 4 on feet 5*a,* 5*b.*

The stand arrangement 1 also includes a top stand-part 6.

The cross-sectional shape of the bar-portions 3*a,* 3*b* on the bottom stand-part 3 conform to the cross-sectional shape of similar bar-portions 6*a,* 6*b* on the top stand-part 6 so as to enable the top stand-part 6 and the sheet 2 to be raised and lowered in relation to the bottom stand-part 3 and said supportive surface 4, through the medium of the mutually mating bar-portions.

The stand arrangement also includes a locking device, described in more detail with reference to FIGS. 8 and 9, which automatically enters a locking state at each selected positional setting of the stand-parts 3, 6 and which is released from its locking state manually. The locking device is spring-activated and when in its locking state is capable of resisting loads acting on the sheet 2, i.e. loads exerted by objects resting on said sheet, among other things, without allowing the bar portions to slip in relation to one another and therewith change the setting of the sheet 2. The locking device can be moved to a release position at each selected positional setting of the stand-parts, to enable the sheet 2 to be raised or lowered and the top stand-part 6 to be moved from one selected positional setting to another positional setting.

The illustrated arrangement also includes spring means (8 or 9) which when raising or lowering the top stand-part 6 function to change the force required herefor, in a known manner.

The top stand-part 6 includes a horizontal beam 6*c* which is provided with a horizontal guide surface 6*d.*

The bottom stand-part 3 is provided with a horizontal beam 3*d.*

The guide surface 6*d* coacts with respective ends 10*a,* 11*a* of two guide rods 10, 11, said end-parts being spaced widely apart. The other end-parts 10*b,* 11*b* of the guide rods 10, 11 are closer together and are pivotally mounted on the bottom stand-part 3 through the medium of a holder 3*c.* The mutually facing end-parts 10*b,*11*b* of the guide rods 10, 11 also coact with a structural member or device 12 which functions to forcibly rotate the two guide rods 10, 11, in a clear and precise movement pattern and the arrangement includes two spring devices 8, 9 which act between said horizontal beam 3*d* at the points 8*a,* 9*a* and against a respective one of said guide rods 10, 11.

The top stand-part 6 includes at least two horizontal beams, ie the aforesaid beam 6*c* and a further beam 6*c′* mounted above the beam 6*c.*

The lowermost horizontal beam 6*c* is provided with said guide surface 6*d* within an upper section of the beam.

The guide surface 6*d* will preferably have the form of a horizontal groove or track in the upper part of the beam 6*c,* with the groove 6*d* open towards one side.

Each of the widely-spaced end-parts 10*a,* 11*a* is provided with a respective bearing means 110*c,* 11*c,* in the form of a ball bearing or roller bearing, which run along the horizontal guide groove 6*d.*

Each guide rod, such as the guide rod 10, is pivotally mounted to the bottom stand-part 3 by means of a pivot shaft 3*e* (3*f*) and the two pivot shafts 3*e,* 3*f* are spaced horizontally apart and contain therebetween the aforesaid structural member or device 12.

As shown in FIG. 4, the device 12 has the form of two mutually facing and mutually coacting toothed segments. A first toothed segment 41 is mounted on the control rod 10 and a second toothed segment 42 is mounted on the control rod 11.

The peripheral teeth or cogs 41*a* of the toothed segment 41 have a pitch such as to enable them to coact with corresponding teeth or cogs 42*a,* and the two toothed segments 41, 42 have mutually the same radius.

This will ensure that rotation of toothed segment 41 about the pivot shaft 3*e* will always result in the same rotation of the toothed segment 42 about its pivot shaft 3*f,* and therewith ensure that the points or the bearing means 10*c* and 11*c* will always be positioned horizontally in relation to one another, irrespective of their vertical position above the underlying supportive surface 4.

The spring means 8, 9 comprises at least one gas-spring device, in the case of the illustrated embodiment two gas-spring devices. The different positions of the gas springs will be apparent when comparing the positions of the stand arrangement 1 shown in FIGS. 2 and 3.

The two gas-spring devices are orientated with the attachment points 3*d,* 3*d′* on the bottom stand-part 3 so coordinated as to cause the gas-spring devices 8, 9 to diverge from one another in an upward direction in relation to a centre line "A" on the stand arrangement.

The attachment points 8*b,* 9*b* of the two spring devices 8, 9 on the guide rods 10, 11 are located laterally of the pivot shafts 3*e,* 3*f.*

At least the position of one of the spring devices 8, 9, such as the attachment point 8*b,* can be adjusted along its respective guide rod, e.g. the guide rod 10, to increase or decrease the force exerted by said spring device.

This adjustment to said attachment point will change the lever ratio or mechanical advantage of the arrangement and adapt the arrangement to suit a currently acting load.

FIG. 3 illustrates identical means 31, (31*a*) for adjusting the position of an attachment point 8*b,* 9*b* on the guide rod 10 or 11.

It will be evident that the closer the attachment point 8*b* lies to the pivot point 3*e,* the smaller will be the force exerted by the spring device 8 on the table 2, and vice versa.

The means 31, 31*a* may have the form of a screw-threaded rod 32 provided with a screw-threaded sleeve 33 which can coact with the gas-spring attachment means 8*b.*

The mutual pivotal movement of the two rods 32, 32*a* can be coordinated with the aid of known means and activated through the medium of a crank device 35 (FIG. 1).

The top stand-part 6 is provided with at least two vertically extending bar-portions 6*a,* 6*b,* and the bottom stand-part is provided with at least two vertically extending bar-portions 3*a,* 3*b.*

The bar-portions 6*a,* 6*b* of the top stand-part 6 have a cross-sectional shape that can be encircled by a cavity formed by the cross-sectional shape of the respective bar-portion 3*a* of the bottom stand-part 3.

The cross-sectional shape of the bar-portion 6*a* of the top stand-part is shown in FIG. 5, and the cross-sectional shape of the bar-portion 3*a* of the bottom stand-part is shown in FIG. 6. A number of guide rollers are mounted in the bar-portion 3*a* of the bottom stand-part.

The bar-portions 6*b* and 3*b* are identical to the bar-portions 6*a* and 3*a.*

As shown in FIG. 5, the bar-portion 6*a* has three projections 61, 62 and 63 which extend from a flat bar 64 and which are shaped and disposed so as to partially embrace requisite guide rollers.

It will be seen from FIG. 6 that the bar-portion 3*a* has a form which presents a cavity 65 adapted to retain a plate 66 in a known manner, said plate 66 having mounted thereon four guide rollers 71–74 embraced by the projections 61, 62 and 63.

There is nothing to prevent two or more guide rollers being disposed in the longitudinal direction of the bar.

FIG. 7 shows the bar-portion 6*a* of the top stand-part inserted into the bar-portion 3*a* of the bottom stand-part, and it will be seen from the Figure that a number of guide rollers or runners 71 to 74 mounted on a plate 66 belonging to the bar-portion of the bottom stand-part are enclosed in a cavity and function to guide the bar-portions as they move up and down.

FIG. 8 illustrates a locking device 80 which is fixedly related within the bar-portion 6*a* of the top stand-part.

Normally, one locking device 80 is used for each pair of bar-portions 6*a,* 3*a* and 6*b,* 3*b* respectively.

The bar-portion 6*a* has exposed side surfaces such as to expose opposite surface sections 75*a,* 75*b* on the bar-portion 3*a*.

The locking device 80 is constructed to exert automatically a clamping effect on mutually opposing surfaces of the bar-portion 3*a* on the bottom stand-part 3, therewith locking said bar-portion.

The locking device 80 is comprised of two locking or clamping jaws 81, 82 and springs 83, 83*a* and 83*b* disposed between said jaws 81, 82 function to urge said jaws apart.

The locking jaws 81 and 82 are mutually identical and have an outer locking or friction-enhancing surface 81*a,* 82*a* and an inner edge 81*b,* 82*b*.

The locking or friction-enhancing surface 81*a,* 82*a* may conveniently comprise a rubber material affixed to an aluminium surface on the locking jaw 81, 82 and active against an aluminium surface 75*a,* 75*b*.

Each of the locking jaws 81 and 82 includes an elongated aperture or groove 85, 86 adapted for loose coaction with a fixed shoulder 85*a,* 86*a*.

A longitudinally extending, edge-related line 85', 86' on the groove 85, 86 defines an angle "a" of 20°–70°, preferably 45°–55°, such as about 50° to the longitudinal axis of the bar-portion.

The locking device can be released by bringing the locking jaws 81, 82 together against the action of said springs, with the aid of a stirrup-like device 88, 89.

The stirrup-like device 88, 89 is shown in the locking or activated state of the locking device in full lines and in the released or deactivated state of the locking device in broken lines.

The stirrup-like devices 88, 89 are moved towards one another with the aid of a wire 90 attached at its free end 91 to a part 88*c,* and a sleeve 92 which surrounds the wire 90 and which is attached to a part 89*c* of the two stirrup-like devices 88, 89.

The wire 90 and the sleeve 92 extend towards the sheet 2 and the wire 90 can be moved relative to the sleeve by means of an activating mechanism 36.

When releasing the locking device, the locking jaws 81, 82 move towards one another and slightly downwards by following the lines 85' and 86'.

The locking jaws are moved towards one another with the aid of the stirrup-like devices 88, 89, each of which can pivot about a respective pivot shaft 88*b* and 89*b* on the locking jaw 81.

A shoulder 88*a* and a shoulder 89*a* are both arranged to press against the edge 82*b* so as to activate said movement of the locking jaws.

As the locking jaws 81, 82 move towards one another, the grooves 85, 86 which each encloses a respective guide pin or guide roller 85*a,* 86*a* will not only be moved towards one another but also in a direction downwards along the lines 85' and 86', so as to provide a simple lock-releasing function and to ensure that a self-clamping effect will be obtained in the locked state of said locking devices.

Smaller values of the angle "a" will increase the pressure against the surfaces 75*a* and 75*b* and therewith increase the clamping or locking effect, while the choice of higher values will have a reverse effect.

The practical application, choice of materials, desired technical effects, etc., are decisive in the choice of the angular value "a".

The invention also provides the possibility of using a tension-limiting unit 95, such as a spring, which will expand when the tension in the wire 90 exceeds a predetermined value.

In the case of self-clamping constructions, it is important that the locking device 80 will not be released from its locking state should the sheet 2 be subjected to excessive loads.

The stirrup-like device 88 can be brought to a lock-active position through the medium of a spring arrangement.

It will be understood that the invention is not restricted to the aforedescribed and illustrated exemplifying embodiment thereof and that modifications are possible within the scope of the inventive concept as illustrated in the following Claims.

I claim:

1. A weight-balancing stand arrangement for supporting a sheet of material, comprising.

a bottom stand-part;

an upper stand-part;

the bottom stand-part having a form related to the top stand-part such that the top stand-part can be raised and lowered relative to the bottom stand-part through two or more positional settings;

an automatically activateable and a manually deactivateable locking arrangement, the locking arrangement being adapted to automatically lock when the bottom stand-part and the upper stand-part are in any selected positional setting of the positional settings, the locking arrangement preventing changes in a position of a sheet of material supported on the stand arrangement when loads act on the sheet of material, and the locking arrangement being manually releasable from each of the positional settings such that the sheet of material and the top stand-part can be raised or lowered from the selected positional setting to a new positional setting;

at least one spring device cooperating with the top stand-part for changing a force required for raising and lowering the top stand-part;

wherein the top stand-part includes a horizontal beam, the horizontal beam including at least on horizontal guide surface, the guide surface cooperating with spaced end-parts of two guide rods, the two guide rods having other end-parts that are closer together than the spaced end parts and are pivotally mounted on the bottom stand-part, the other end-parts cooperating with a device for forcibly generating a related pattern of movement of the two guide rods, the spring device being disposed between the bottom stand-part and each of the two guide rods.

2. An arrangement according to claim 1, wherein the at one horizontal beam comprises at least two horizontal beams, the horizontal beams being disposed at different levels in a vertical direction, and two vertical beams.

3. An arrangement according to claim 2, wherein a lowermost horizontal beam of the horizontal beams includes the guide surface.

4. An arrangement according to claim 3, wherein the guide surface includes a horizontal track.

5. An arrangement according to claim 4, wherein the spaced end-parts include bearing means, the bearing means running along the track.

6. An arrangement according to claim 1, wherein the spaced end-parts include bearing means the bearing means running in tracks on the guide surface.

7. An arrangement according to claim 1, wherein each guide rod of the two guide rods is pivotally mounted on the bottom stand-part via a respective pivot shaft, each pivot shaft being spaced horizontally apart from the other pivot shaft and include the device for forcibly generating a related pattern of movement therebetween, the device for forcibly generating a related pattern of movement including a structural member.

8. An arrangement according to claim 7, wherein the structural member includes mutually coacting toothed segments.

9. An arrangement according to claim 7, wherein the spring device includes a first and a second spring device, the first and second spring devices having attachment points on respective ones of the two guide rods.

10. An arrangement according to claim 1, wherein the spring device includes at least one gas-spring device.

11. An arrangement according to claim 10, wherein the spring device includes a first and a second spring device that are oriented relative to each other so as to be mutually divergent.

12. An arrangement according to claim 1, wherein the spring device includes a first and a second spring device that are oriented relative to each other so as to be mutually divergent.

13. An arrangement according to claim 12, wherein the first and second spring devices have attachment points on respective ones of the two guide rods.

14. An arrangement according to claim 1, wherein the spring device includes a first and a second spring device, the first and second spring devices having attachment points on respective ones of the two guide rods.

15. An arrangement according to claim 14, a position of at least one of the attachment points is adjustable to alternately increase or decrease the force required for raising and lowering the top stand-part.

16. An arrangement according to claim 1, wherein the spring device has an attachment point on at least one of the two guide rods, and a position of the attachment point is adjustable to alternately increase or decrease the force required for raising and lowering the top stand-part.

17. An arrangement according to claim 1, wherein the top stand-part includes at least two vertically extending bar-portions.

18. An arrangement according to claim 17, wherein the bottom stand-part includes at least two vertically extending bar-portions.

19. An arrangement according to claim 18, wherein the bar-portions of the bottom stand-part define a cavity, and the bar-portions of the top stand-part are shaped and disposed such that they are at least partially encircled by the cavity.

20. An arrangement according to claim 19, wherein a locking arrangement is disposed within at least one of the bar-portions on the top stand-part and is adapted to clamp against one of the bar-portions on the bottom stand-part.

21. An arrangement according to claim 20, wherein the locking arrangement comprises two jaws, the jaws being urged apart into a locking position by springs disposed between the two jaws.

22. An arrangement according to claim 21, wherein the locking jaws are movable towards one another and downwards from the locking position to an unlocked position.

23. An arrangement according to claim 22, wherein the locking arrangement includes an upper and a lower stirrup device, the upper and the lower stirrup device being movable towards one another to move the locking jaws from a locking to a lock-releasing position.

24. An arrangement according to claim 21, wherein each locking jaw includes an edge-part and an opposing part, the opposing part including friction-enhancing material.

25. An arrangement according to claim 24, wherein the locking arrangement includes an upper and a lower stirrup device, the upper and the lower stirrup device being movable towards one another to move the locking jaws from a locking to a lock-releasing position.

26. An arrangement according to claim 18, wherein at least one of the bar-portions of the bottom stand-part defines a cavity, and a plurality of guide rollers are attached to the bar-portions of the bottom stand-part and are enclosed by the cavity.

* * * * *